US012031462B2

(12) United States Patent
Taylor et al.

(10) Patent No.: US 12,031,462 B2
(45) Date of Patent: Jul. 9, 2024

(54) SELF-CONTAINED COMPRESSION BRAKE CONTROL MODULE FOR INTEGRATED ROCKER ARM ENGINE BRAKING AND METHODS

(71) Applicant: Pacbrake Company, Blaine, WA (US)

(72) Inventors: Kody Taylor, Surrey (CA); Peter Stec, Vancouver (CA)

(73) Assignee: Pacbrake Company, Blaine, WA (US)

( * ) Notice: Subject to any disclaimer, the term of this patent is extended or adjusted under 35 U.S.C. 154(b) by 0 days.

(21) Appl. No.: 18/211,890

(22) Filed: Jun. 20, 2023

(65) Prior Publication Data

US 2023/0407773 A1 Dec. 21, 2023

Related U.S. Application Data

(60) Provisional application No. 63/353,890, filed on Jun. 21, 2022.

(51) Int. Cl.

| | |
|---|---|
| ***F01L 13/06*** | (2006.01) |
| ***F01L 1/18*** | (2006.01) |
| ***F01L 1/24*** | (2006.01) |
| ***F01L 1/26*** | (2006.01) |
| ***F01L 1/46*** | (2006.01) |

(52) U.S. Cl.

CPC ..... *F01L 13/06* (2013.01); *F01L 1/181* (2013.01); *F01L 1/2411* (2013.01); *F01L 1/267* (2013.01); *F01L 1/46* (2013.01); *F01L 13/065* (2013.01)

(58) Field of Classification Search

CPC ..... F01L 1/181; F01L 1/2411; F01L 1/267; F01L 1/46; F01L 13/06; F01L 13/065

USPC ..... 123/90.39, 90.4, 90.44

See application file for complete search history.

(56) References Cited

U.S. PATENT DOCUMENTS

| | | | | |
|---|---|---|---|---|
| 8,272,363 | B2 | 9/2012 | Meneely | |
| 11,149,659 | B2 | 10/2021 | Stec | |
| 2010/0024767 | A1* | 2/2010 | Meneely | F02D 13/04 123/323 |
| 2015/0144096 | A1* | 5/2015 | Meneely | F01L 1/181 123/321 |
| 2017/0276035 | A1* | 9/2017 | Cecur | F01L 1/2416 |

(Continued)

FOREIGN PATENT DOCUMENTS

CN 203097985 U * 7/2013

*Primary Examiner* — Jorge L Leon, Jr.

(74) *Attorney, Agent, or Firm* — Calderon, Safran & Wright P.C.

(57) ABSTRACT

An exhaust rocker assembly for operating an exhaust valve of an engine during a compression-release engine braking operation. The exhaust rocker assembly comprises an exhaust rocker arm and a self-contained compression brake control module (CBCM) mounted to the exhaust rocker arm and operatively coupled to the exhaust valve for controlling a lift and a phase angle thereof. The CBCM includes a casing, an actuation piston disposed outside the casing so as to define an actuation piston cavity, a reset check valve provided between the casing and the actuation piston, and a compression brake actuator disposed in the casing. The actuation piston reciprocates relative to the casing. The compression brake actuator includes a control piston. The control piston engages the check valve when deactivated so as to unlock the actuation piston cavity and disengages from the check valve when activated so as to lock the actuation piston cavity.

17 Claims, 5 Drawing Sheets

(56) References Cited

U.S. PATENT DOCUMENTS

| | | | | |
|---|---|---|---|---|
| 2018/0073401 | A1* | 3/2018 | Andrisani | F01L 13/06 |
| 2019/0010835 | A1* | 1/2019 | McCarthy, Jr. | F01L 1/267 |
| 2019/0309664 | A1* | 10/2019 | Batcheller | F01L 1/181 |
| 2020/0182098 | A1* | 6/2020 | McCarthy, Jr. | F01L 1/24 |
| 2021/0156319 | A1* | 5/2021 | Stec | F01L 1/46 |

* cited by examiner

SELF-CONTAINED COMPRESSION BRAKE CONTROL MODULE FOR INTEGRATED ROCKER ARM ENGINE BRAKING AND METHODS

CROSS-REFERENCE TO RELATED APPLICATION AND CLAIM TO PRIORITY

This application claims the benefit of U.S. Provisional Patent Application No. 63/353,890 filed Jun. 21, 2022 by Taylor et al., which is hereby incorporated herein by reference in its entirety and to which priority is claimed.

BACKGROUND OF THE INVENTION

1. Field of the Invention

The present invention relates to compression-release brake systems for internal combustion engines in general and, more particularly, to a self-contained compression-release brake control module for a compression-release engine brake system of an internal combustion engine and methods of using the a self-contained compression-release brake control module for a compression-release engine brake system.

2. Description of the Related Art

For internal combustion engines (IC engine), especially diesel engines of large trucks, engine braking is an important feature for enhanced vehicle safety. Consequently, the diesel engines in vehicles, particularly large trucks, are commonly equipped with compression-release engine brake systems (or compression-release retarders) for retarding the engine (and thus, the vehicle as well) in order to slow the truck. The compression release engine braking provides significant braking power in a braking mode of operation. For this reason, the compression-release engine brake systems have been in North America since the 1960's and gained widespread acceptance.

The typical compression-release engine brake system opens an exhaust valve(s) just prior to Top Dead Center (TDC) at the end of a compression stroke. This creates a blow-down of the compressed cylinder gas and the energy accumulated during compression is not reclaimed. The result is engine braking, or retarding, power. A conventional compression-release engine brake system has substantial costs associated with the hardware required to open the exhaust valve(s) against the extremely high load of the compressed cylinder charge. Valve train components must be designed and manufactured to operate reliably at both high mechanical loading and engine speeds. Also, the sudden release of the highly compressed gas comes with a high level of noise. In some areas, typically urban areas, engine brake use is not permitted because the existing compression-release engine brake systems open the valves quickly at high compression pressure near the TDC compression and produces high engine valve train loads and a loud sound. It is the loud sound that has resulted in prohibition of engine compression release brake usage in certain urban areas.

Typically, the compression-release engine brake systems up to this time are unique, i.e., custom designed and engineered to a particular engine make and model. The design, prototype fabrication, bench testing, engine testing and field testing typically require twenty four (24) months to complete prior to sales release. Accordingly, both the development time and cost have been an area of concern.

Exhaust brake systems can be used on engines where compression release loading is too great for the valve train. The exhaust brake mechanism consists of a restrictor element mounted in the exhaust system. When this restrictor is closed, backpressure resists the exit of gases during the exhaust cycle and provides a braking function. This system provides less braking power than a compression release engine brake, but also at less cost. As with a compression release brake, the retarding power of an exhaust brake falls off sharply as engine speed decreases. This happens because the restriction is optimized to generate maximum allowable backpressure at rated engine speed. The restriction is simply insufficient to be effective at the lower engine speeds.

U.S. Pat. No. 8,272,363 describes a self-contained compression brake control module (CBCM) for controlling exhaust valve motion, primarily for, but not limited to, the purpose of engine retarding. The CBCM described in U.S. Pat. No. 8,272,363 is often required to operate with a significant axial offset between a longitudinal axis of the CBCM and a longitudinal valve axis of an exhaust valve it acts upon, as illustrated in FIGS. 2A-2C of the U.S. Pat. No. 8,272,363. The CBCM described in U.S. Pat. No. 8,272,363 comprises an actuation piston retaining ring and seal engaging the same bore within a single casing of the CBCM. This causes an increased diameter requirement in a portion of the bore due to assembly concerns with passing a seal past a retaining ring groove. The CBCM of U.S. Pat. No. 8,272,363 utilizes a casing that contains the actuation piston while still requiring a support housing, adding diameter to the overall assembly. These contributors to a required offset generate a side force acting on the actuation piston of the CBCM, which may cause a risk of wear and/or jamming of the actuation piston in its bore. Practical applications for the CBCM often dictate both a reduction in overall height and diameter in order to fit within existing engine packages without interference or undesired changes to other components. It is therefore advantageous to be able to reduce the size of the CBCM module, to both better center it over the loading generated by the exhaust valve, and to package it into tighter space constraints.

Similarly, U.S. Pat. No. 11,149,659, which is incorporated herein by reference, describes a self-contained, compact hydraulic compression brake control module, which is used to selectively modify the lift and phase angle of an exhaust valve. The brake control module of U.S. Pat. No. 11,149,659 is disclosed as fixed in position relative to the cylinder head of the diesel engine.

Compression-release engine brake systems of modern engine often integrate key engine brake components into a rocker arm, which is therefore positioned movably relative to a cylinder head of a diesel engine, such as lost motion compression-release engine brake systems and dedicated cam compression-release engine brake systems. Lost motion compression-release engine brake systems are compression-release engine brake systems that position components into an exhaust rocker arm, while dedicated cam compression-release engine brake systems are compression-release engine brake systems that position components into a dedicated engine brake rocker arm, which is independent of intake and exhaust rocker arms.

While known compression-release engine brake systems have proven to be acceptable for various vehicular engine applications, such devices are nevertheless susceptible to improvements that may enhance their performance and cost. With this in mind, a need exists to develop improved compression-release engine brake systems that advance the art, such as a self-contained compression brake control module for a compression-release brake system of an internal combustion engine capable of performing "dedicated cam" engine braking and both "lost motion" and "dedicated cam" engine braking. Such systems should be easier to assemble, be more robust and compact when assembled, while enhancing performance, improving functionality and significantly reducing the development time and cost of the compression-release engine brake system.

SUMMARY OF INVENTION

According to a first aspect of the present invention, there is provided an exhaust rocker assembly for operating at least one exhaust valve of an internal combustion engine during a compression-release engine braking operation. The exhaust rocker assembly comprises an exhaust rocker arm and a self-contained compression brake control module mounted to the exhaust rocker arm and operatively coupled to the at least one exhaust valve for controlling the lift and phase angle of the at least one exhaust valve. The compression brake control module maintains the at least one exhaust valve open during a compression stroke of the internal combustion engine when the internal combustion engine performs the compression-release engine braking operation. The compression brake control module comprises a hollow casing including a single-piece body mounted in the exhaust rocker arm, and a hollow actuation piston disposed outside the casing and in the exhaust rocker arm so as to define a variable volume hydraulic actuation piston cavity between the hollow casing and the actuation piston. The casing defines an internal actuator cavity therewithin and includes a hollow inner portion extending away from the internal actuator cavity. The actuation piston reciprocates relative to the hollow inner portion of the hollow casing between an extended position and a collapsed position, and the actuation piston is configured to engage the at least one exhaust valve when in the extended position of the actuation piston. The actuation piston cavity and the internal actuator cavity are in fluid communication with each other through a connecting passage in the hollow casing. The hollow inner portion of the hollow casing extends into the actuation piston. The compression brake control module further comprises a reset check valve between the connecting passage and the actuation piston cavity, and a compression brake actuator disposed in the internal actuator cavity configured to control the reset check valve. The reset check valve is configured to hydraulically lock the actuation piston cavity when the pressure of the hydraulic fluid within the actuation piston cavity exceeds the pressure of the hydraulic fluid in a supply port formed in the hollow casing. The reset check valve is biased closed by a biasing spring. The compression brake actuator includes a control piston exposed to atmospheric pressure. The control piston is slidingly mounted within the internal actuator cavity so as to reciprocate between an extended position and a retracted position. The compression brake control module also comprises a control piston spring configured to bias the control piston toward the retracted position of the control piston in which the control piston engages and opens the reset check valve solely by the biasing force of the control piston spring, so as to unlock the actuation piston cavity and fluidly connect the actuation piston cavity to the supply port.

According to a second aspect of the invention, there is provided a method of operating an exhaust rocker assembly operating at least one exhaust valve of an internal combustion engine during a compression-release engine braking operation. The exhaust rocker assembly comprises an exhaust rocker arm formed with a control bore therewithin and a self-contained compression brake control module mounted to the exhaust rocker arm and operatively coupled to the at least one exhaust valve for controlling the lift and phase angle of the at least one exhaust valve. The compression brake control module maintains the at least one exhaust valve open during a compression stroke of the internal combustion engine when the internal combustion engine performs the compression-release engine braking operation. The compression brake control module comprises a hollow casing including a single-piece body mounted in the control bore, and a hollow actuation piston disposed outside the casing and in the control bore so as to define a variable volume hydraulic actuation piston cavity between the hollow casing and the actuation piston. The casing defines an internal actuator cavity therewithin and includes a hollow inner portion extending away from the internal actuator cavity. The actuation piston reciprocates relative the hollow inner portion of the hollow casing within the control bore between an extended position and a collapsed position. The actuation piston is configured to engage the at least one exhaust valve in the extended position of the actuation piston. The actuation piston cavity and the internal actuator cavity are in fluid communication with each other through a connecting passage in the hollow casing. The hollow inner portion of the hollow casing extends into the actuation piston. The compression brake control module further comprises a check valve between the connecting passage and the actuation piston cavity, and a compression brake actuator disposed in the internal actuator cavity to control the check valve. The check valve hydraulically locks the actuation piston cavity when the pressure of the hydraulic fluid within the actuation piston cavity exceeds the pressure of the hydraulic fluid in a supply port. The check valve is biased closed by a biasing spring. The compression brake actuator includes a control piston exposed to atmospheric pressure. The control piston is slidingly mounted within the internal actuator cavity so as to reciprocate between an extended position and a retracted position. The compression brake control module also comprises a control piston spring configured to bias the control piston toward the retracted position of the control piston in which the control piston engages and opens the check valve solely by the biasing force of the control piston spring so as to unlock the actuation piston cavity and fluidly connect the actuation piston cavity to the supply port. The method of operating an exhaust rocker assembly comprises the steps of biasing the reset check valve closed by the pressurized hydraulic fluid supplied from a source to the compression brake control module to extend the hollow activation piston and hydraulically bias the reset check valve closed during a braking operation mode of the engine, and resetting the at least one exhaust valve by stopping the pressurized hydraulic fluid supplied to the compression brake control module to open the reset check valve and allow retraction of the hollow activation piston during a positive power operation mode of the engine.

Other aspects of the invention, including systems, assemblies, subassemblies, units, engines, processes, and the like which constitute part of the invention, will become more apparent upon reading the following detailed description of the exemplary embodiments.

BRIEF DESCRIPTION OF THE DRAWINGS

Additional objects and advantages of the invention will become apparent from a study of the following specification when viewed in light of the accompanying drawings, wherein.

DETAILED DESCRIPTION OF PREFERRED EMBODIMENT(S)

Figure 1:
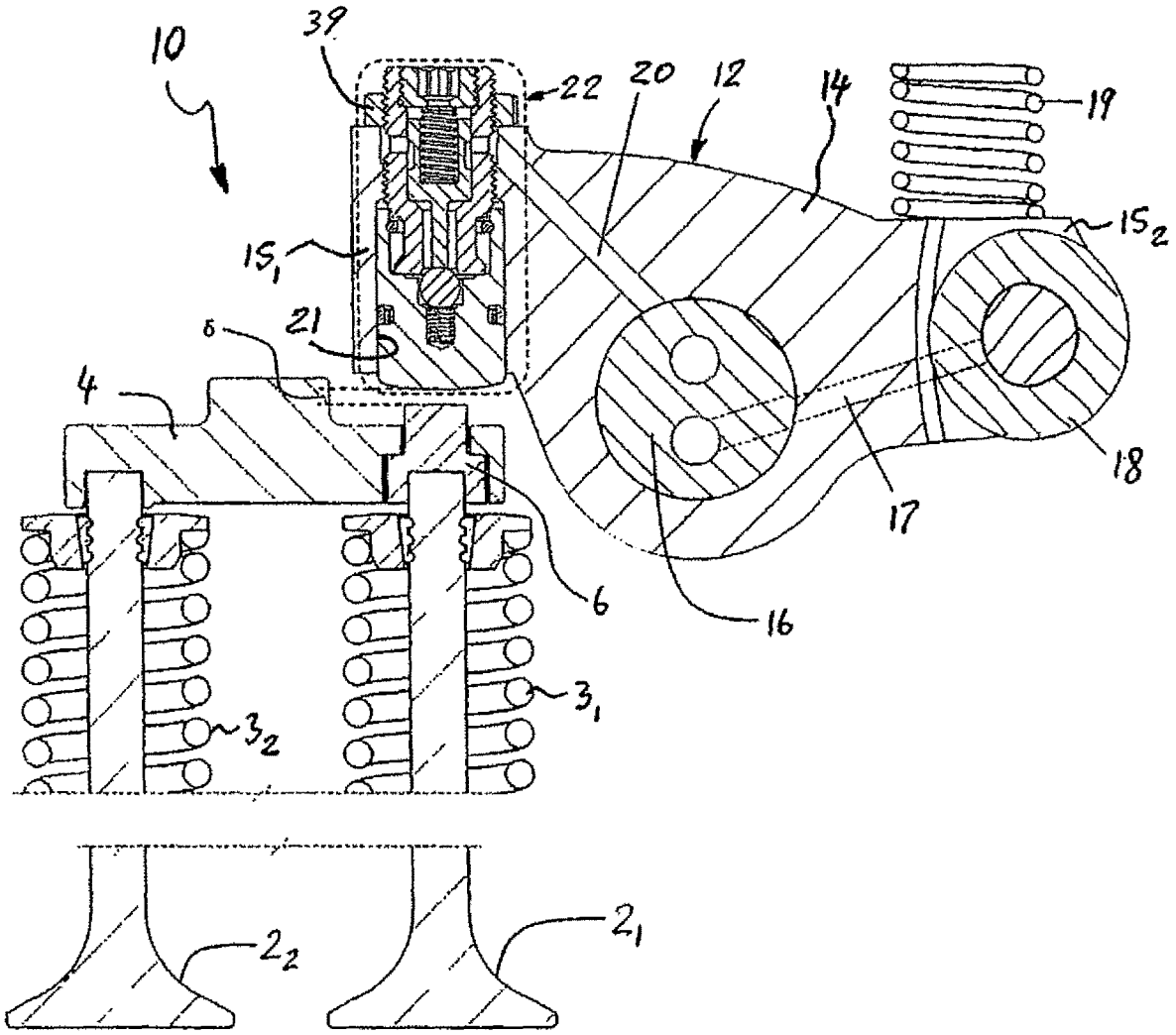
FIG. 1 is a sectional view of a dedicated compression-release engine brake rocker assembly according to a first exemplary embodiment of the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiment(s) is intended to be read in connection with the accompanying drawings, which are to be considered part of the entire written description. In the description, relative terms such as "horizontal," "vertical," "up," "down," "upper", "lower", "right", "left", "top" and "bottom", "front" and "rear", "inwardly" and "outwardly" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "unitary") relates to a part made as a single part, or a part made of separate components fixedly (i.e., non-moveably) connected together. The words "smaller" and "larger" refer to relative size of elements of the apparatus of the present invention and designated portions thereof. Additionally, the word "a" and "an" as used in the claims means "at least one" and the word "two" as used in the claims means "at least two".

FIG. 1 depicts a compression-release engine brake system 10, according to a first exemplary embodiment of the present invention, for an internal combustion (IC) engine. The compression-release engine brake system 10 is a dedicated cam compression-release engine brake system (or dedicated cam engine brake system). Preferably, the IC engine is a four-stroke diesel engine, conventionally comprising a cylinder block including one or more cylinders (not shown). Each cylinder is provided with two intake valves (not shown), and first and second exhaust valves $\mathbf{2}_1$ and $\mathbf{2}_2$, and a valve train for lifting (opening) and closing the exhaust valves $\mathbf{2}_1$ and $\mathbf{2}_2$. Each of the exhaust valves $\mathbf{2}_1$ and $\mathbf{2}_2$ is provided with a return spring exerting a closing force on the associated exhaust valve to urge the exhaust valves $\mathbf{2}_1$ and $\mathbf{2}_2$ into a closed position. The return springs of the first and second exhaust valves $\mathbf{2}_1$ and $\mathbf{2}_2$ (also known as exhaust valve springs) are designated by reference numerals $\mathbf{3}_1$ and $\mathbf{3}_2$, respectively.

The exhaust valves $\mathbf{2}_1$ and $\mathbf{2}_2$ are substantially structurally identical in this embodiment. In view of these similarities, and in the interest of simplicity, the following discussion will sometimes use a reference numeral without a letter to designate both substantially identical valves. For example, the reference numeral 2 will sometimes be used when generically referring to each of the exhaust valves $\mathbf{2}_1$ and $\mathbf{2}_2$ rather than reciting both reference numerals. It will be appreciated that each engine cylinder may be provided with one or more intake valve(s) and/or exhaust valve(s), although two exhaust valves are shown in FIG. 1. The IC engine is capable of performing both positive power operation (normal engine cycle) and engine brake operation (engine brake cycle). The compression-release brake system 10 operates in a compression brake (or brake-on) mode during the engine brake operation and a compression brake deactivation (or brake-off) mode during the positive power operation.

The dedicated cam compression-release brake system 10 comprises a dedicated engine brake rocker assembly 12 added to each engine cylinder in addition to conventional intake and exhaust rocker assemblies, respectively. The dedicated engine brake rocker assembly 12 operates only one of the exhaust valves $\mathbf{2}_1$ and $\mathbf{2}_2$. Correspondingly, the dedicated engine brake rocker assembly 12 according to the first exemplary embodiment of the present invention includes a dedicated engine brake rocker arm 14 pivotally mounted about an engine brake rocker shaft 16 and provided to open only the first exhaust valve $\mathbf{2}_1$ through a thru-pin (or valve bridge pin) 6 extending through exhaust valve bridge 4. The valve bridge pin 6 is reciprocatingly mounted to the exhaust valve bridge 4 and is slidably movable relative to the exhaust valve bridge 4 to allow the first exhaust valve $\mathbf{2}_1$ to be operated in the brake-on mode.

The dedicated engine brake rocker arm 14, as best shown in FIG. 1, has two ends: a driving (first distal) end $\mathbf{15}_1$ controlling the first exhaust valve $\mathbf{2}_1$, and a driven (second distal) end $\mathbf{15}_2$ adapted to contact a dedicated engine brake cam (not shown). The dedicated engine brake rocker arm 14 includes a dedicated engine brake cam follower 18 mounted to the driven end $\mathbf{15}_2$ of the engine brake rocker arm 14, as best shown in FIG. 1. According to the exemplary embodiment, the dedicated engine brake cam follower 18 is, for example, a cylindrical roller rotatably mounted to the driven end $\mathbf{15}_2$ of the engine brake rocker arm 14. The engine brake cam follower 18 is provided to contact the dedicated engine brake cam. The engine brake cam follower 18 receives input motion from the dedicated engine brake cam. Thus, the engine brake cam follower 18 defines a camshaft interface. Alternatively, the camshaft interface can be adapted to suit engine requirements, for example with a ball or socket for a push-rod type interface.

The engine brake rocker shaft 16 is configured to deliver continuous lubrication to the engine brake cam follower 18 via a lubrication conduit 17 formed in the engine brake rocker arm 14.

As further illustrated in FIG. 1, the dedicated engine brake rocker assembly 12 comprises a self-contained compression brake control module (or CBCM) 22 for selectively controlling the lift and phase angle of one of the exhaust valves $\mathbf{2}_1$ and $\mathbf{2}_2$, specifically of the first exhaust valve $\mathbf{2}_1$. As shown in FIG. 1, the CBCM 22 is located above the thru-pin 6. In the first exemplary embodiment, the CBCM 22 controls exhaust valve motion primarily for, but not limited to, the purpose of engine retarding. Specifically, the CBCM 22 is primarily for selectively controlling the lift and phase angle of the first exhaust valve $\mathbf{2}_1$, which functions as a brake exhaust valve. Also, the dedicated engine brake rocker assembly 12 employs the CBCM 22 to remove valve lash δ from the brake valve train to allow activation of the engine brake in order to open a single exhaust valve $\mathbf{2}_1$ or both exhaust valves $\mathbf{2}_1$ and $\mathbf{2}_2$ at a fast rate of rise with maximum allowable lift near top dead center (TDC) of a compression stroke. Late opening with rapid rate of valve lift assures high peak cylinder pressure and quick cylinder blow-down during the beginning of the expansion stroke and consequently a high degree of engine brake retarding power from the diesel engine.

The engine brake cam (not shown) is configured to drive (or pivot) the engine brake rocker arm 14 towards the exhaust valve bridge 4 near TDC of the compression stroke. The CBCM 22 is also provided for selectively controlling valve lash (initial spacing) δ of the first exhaust valve $\mathbf{2}_1$, as shown in FIG. 1. The valve lash δ is set between the CBCM 22 and the valve bridge pin 6, preferably by adjustment of the CBCM 22 relative to the engine brake rocker arm 14. Alternatively, equivalent valve lash may be set between the engine brake cam follower 18 and the engine brake cam (not shown). The valve lash δ is set such that when the compression-release brake system 10 is in the brake-off (i.e., deactivated) mode, there is sufficient clearance so that the brake cam motion near TDC is not transferred through to the first exhaust valve $\mathbf{2}_1$.

A biasing force to the engine brake rocker arm 14 is applied to maintain the valve lash δ and keep the engine brake rocker assembly 12 in a de-energized state to avoid "clatter" between the engine brake cam and engine brake cam follower 18. In the first exemplary embodiment shown in FIG. 1, a biasing spring 19 is fixedly positioned relative to the engine cylinder head (not shown), and contacts the driven end $\mathbf{15}_2$ of the engine brake rocker arm 14 such that the biasing (or retaining) force of the spring 19 retains the dedicated engine brake cam follower 18 in contact with the dedicated engine brake cam applied to the driven end $\mathbf{15}_2$ of the engine brake rocker arm 14.

Alternately, the biasing spring 19 may be relocated relative to the dedicated engine brake rocker arm 14, such that the retaining force is applied to bias the engine brake cam follower 18 away from the engine brake cam, and the function of the dedicated engine brake rocker assembly 12 as otherwise disclosed is retained. Further alternatively, a camshaft interface may be adapted to suit engine requirements, for example with a ball or socket for a push-rod type interface. It will be evident to one skilled in the art, that the overhead engine brake cam follower 18 may be substituted with a cam-in-block push tube assembly, and the function of the dedicated engine brake rocker assembly 12 as otherwise disclosed will be retained.

Figure 2A:
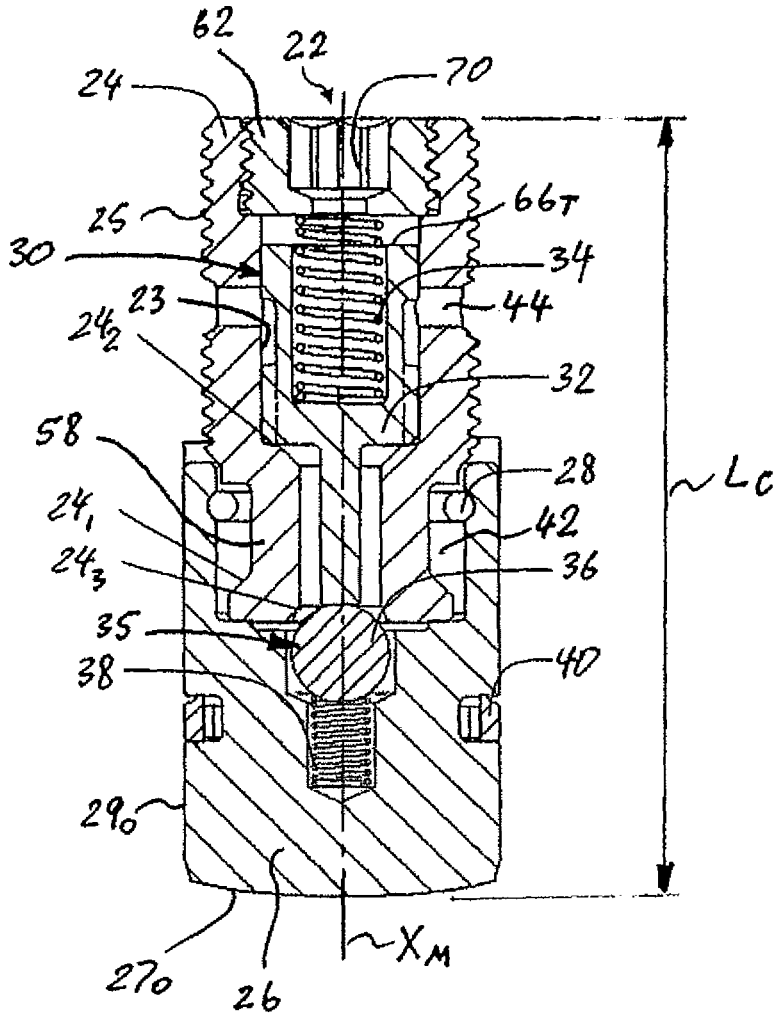
FIG. 2A is a sectional view of a hydraulically actuated compression brake control module of the engine brake rocker assembly according to the first exemplary embodiment of the present invention in a deactivated state.
Figure 2B:
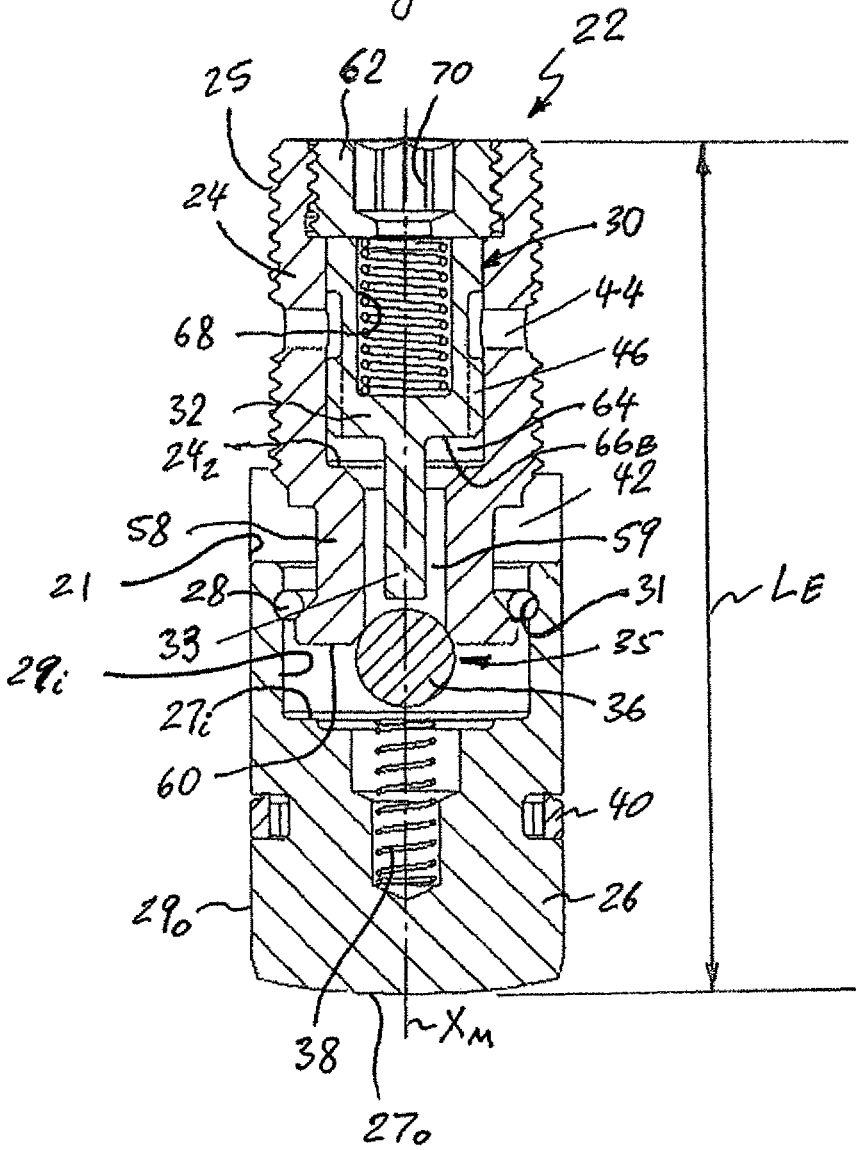
FIG. 2B is a sectional view of the hydraulically actuated compression brake control module of the engine brake rocker assembly according to the first exemplary embodiment in an activated state.
Figure 4A:
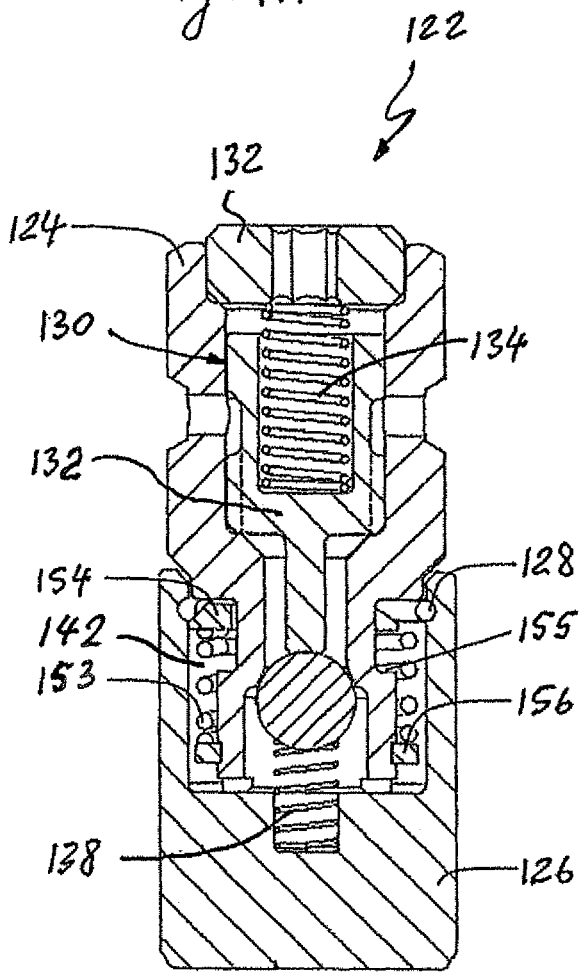
FIG. 4A is a sectional view of a hydraulically actuated compression brake control module of the lost motion compression-release engine brake rocker assembly according to the second exemplary embodiment of the present invention in a deactivated state.
Figure 4B:
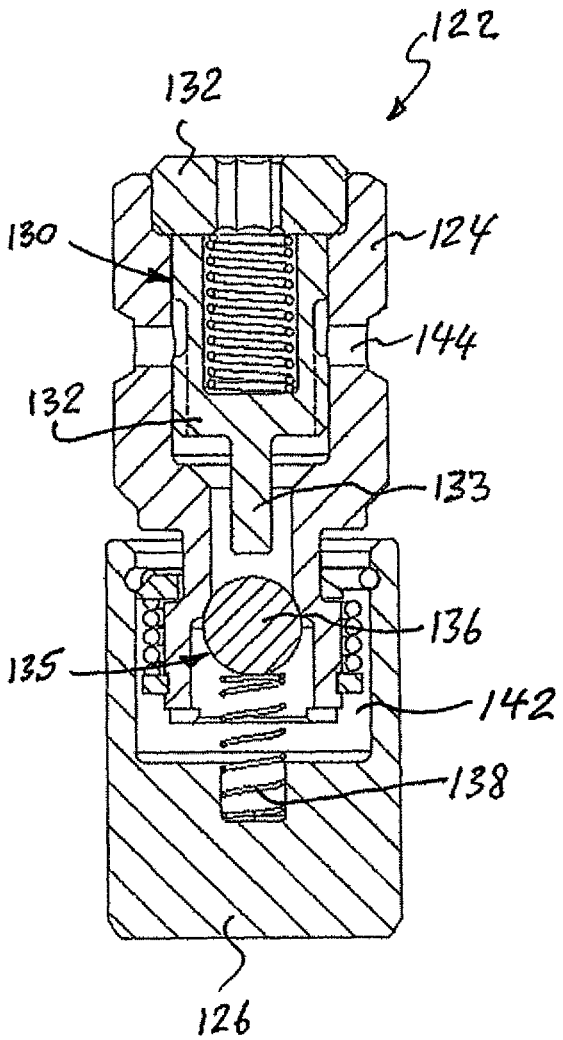
FIG. 4B is a sectional view of the hydraulically actuated compression brake control module of the lost motion compression-release engine brake rocker assembly according to the second exemplary embodiment in an activated state.

The CBCM 22 is a hydraulically actuated compression brake control module, as shown in FIGS. 1-2B. Alternatively, a variation on the CBCM that includes internal spring-return features as shown in FIGS. 4A-4B could be employed.

A compression brake fluid passageway (oil conduit) 20 is provided within the dedicated engine brake rocker arm 14 to provide fluid communication between the hydraulically actuated CBCM 22 and a source 80 of pressurized hydraulic fluid. Preferably, the source 80 of the pressurized hydraulic fluid is an engine oil pump (not shown) of the diesel engine. Correspondingly, in this exemplary embodiment, engine lubricating oil is used as the working hydraulic fluid stored in a hydraulic fluid sump. It will be appreciated that any other appropriate source of the pressurized hydraulic fluid and any other appropriate type of fluid is within the scope of the present invention. The compression brake fluid passageway 20 selectively supplies the pressurized hydraulic fluid from the source to the CBCM 22, so as to switch the CBCM 22 between a deactivated (or brake-off) state (shown in FIG. 2A) when the pressurized hydraulic fluid is not supplied to the CBCM 22, and an activated (or brake-on) state (shown in FIG. 2B) when the pressurized hydraulic fluid is supplied to the CBCM 22. The dedicated engine brake rocker assembly 12 is activated by supplying pressurized hydraulic fluid to the CBCM 22 through the compression brake fluid passageway 20. This causes the CBCM 22 to extend, and to maintain the activated state (extended position) until the pressurized hydraulic fluid is removed (as described in the U.S. Pat. No. 11,149,659). In the brake-on state, the valve lash δ is sufficiently decreased so that the brake cam motion is transferred to the first exhaust valve $\mathbf{2}_1$ via the valve bridge pin 6.

FIGS. 2A and 2B are sectional views of the CBCM 22 in the deactivated and activated state, respectively. In the first exemplary embodiment, illustrated in FIGS. 1-2B, the CBCM 22 is disposed adjacent to the first exhaust valve $\mathbf{2}_1$ and above the valve bridge pin 6. As illustrated in detail in FIGS. 2A and 2B, the CBCM 22 comprises a hollow casing 24 in the form of a cylindrical single-piece hollow body, a hollow actuation piston 26 slidingly mounted to the casing 24, and a retaining ring 28 mounted to the actuation piston 26. Specifically, as best shown in FIGS. 2A and 2B, the retaining ring 28 is disposed inside the actuation piston 26 and mounted in a groove 31 formed on an inner peripheral surface 29*i* of the actuation piston 26.

As further illustrated in FIGS. 1-2B, a cylindrical outer peripheral surface 25 of the casing 24 is at least partially threaded, so as to be threadedly received in an internally partially threaded cylindrical control bore 21 formed in the driving end $\mathbf{15}_1$ of the engine brake rocker arm 14 (best shown in FIGS. 1-2B). The cylindrical single-piece body 24 includes a unitary, hollow cylindrical inner portion 58. A lock nut 39 (best shown in FIG. 1) is provided to adjustably fasten and non-moveably retain the casing 24 of the CBCM 22 to the driving end $\mathbf{15}_1$ of the dedicated engine brake rocker arm 14, i.e., to lock the casing 24 of the CBCM 22 in position relative to the engine brake rocker arm 14. Thus, the casing 24 of the CBCM 22 is non-movably, i.e., fixedly, mounted to the engine brake rocker arm 14.

More specifically, as illustrated in detail in FIGS. 2A and 2B, the actuation piston 26 is slidingly mounted to the casing 24 for slidingly reciprocating within a non-threaded portion of the cylindrical control bore 21 in the exhaust rocker arm 14 (best shown in FIGS. 2A and 2B) and relative to the casing 24 of the CBCM 22 between a deactivated state (i.e., collapsed (or retracted) position) (shown in FIG. 2A) and an extended position (shown in FIG. 2B). Accordingly, the casing 24 and the actuation piston 26 define a variable volume hydraulic actuation piston cavity (or chamber) 42 therebetween within the cylindrical control bore 21, including between an inner end face 27*i* of the actuation piston 26 and the casing 24.

The CBCM 22 has a longitudinal axis $X_M$, as best shown in FIGS. 2A and 2B. The actuation piston 26 is coaxial with the longitudinal axis $X_M$ of the CBCM 22, as best shown in FIGS. 2A and 2B. An outer end (or contact) face 27*o* of the actuation piston 26 engages the brake exhaust valve $\mathbf{2}_1$ when in the extended position through the valve bridge pin 6 reciprocatingly mounted to the exhaust valve bridge 4. The valve bridge pin 6 is reciprocatingly movable relative to the exhaust valve bridge 4 so as to make the brake exhaust valve $\mathbf{2}_1$ movable relative to the exhaust valve $\mathbf{2}_2$ and the exhaust valve bridge 4. The actuation piston 26 slidingly reciprocates relative to the casing 24 within a non-threaded portion of the cylindrical control bore 21 in the driving end $\mathbf{15}_1$ of the engine brake rocker arm 14, as best shown in FIGS. 1-2B, between a retracted (or collapsed) position, shown in FIG. 2A, and an extended position, shown in FIG. 2B. An extension limit is defined by the position of the retaining ring 28 in the actuation piston 26 and a retaining ring seat (or inner stopping surface) $\mathbf{24}_1$ formed on the casing 24. The retaining ring 28 is configured to stop movement of the actuation piston 26 such that the actuation piston 26 is in the extended position when the retaining ring 28 engages the inner stopping surface $\mathbf{24}_1$. The length of the CBCM 22 in the extended position (illustrated in FIG. 2B) is $L_E$, while the length of the CBCM 22 in the collapsed position (illustrated in FIG. 2A) is $L_C$, which is smaller than the length $L_E$.

In the exemplary embodiment illustrated in FIG. 1, the CBCM 22 is fixed (i.e., non-movably attached to the rocker arm 14). Specifically, the CBCM 22 is mounted to the exhaust rocker arm 14 and located adjacent to the exhaust valves $\mathbf{2}_1$, $\mathbf{2}_2$. As illustrated in detail in FIGS. 2A-2B, the CBCM 22 comprises a hollow casing in the form of a cylindrical single-piece body 24 including a unitary, hollow cylindrical inner portion 58. The cylindrical single-piece body 24 also defines a cylindrical internal actuator cavity 23.

The CBCM 22 further comprises a hydraulic compression brake actuator 30 mounted within the actuator cavity 23 of the casing 24. The compression brake actuator 30 in turn comprises a control piston 32 slidingly mounted within the casing 24, an end cap 62, and a control piston spring 34 disposed within the casing 24 between the control piston 32 and the end cap 62 to bias the control piston 32 toward the actuation piston 26. As illustrated in FIGS. 2A-2B, the control piston 32 is formed integrally with a control piston pin 33 extending into the cylindrical inner portion 58 of the hollow casing 24. The control piston 32 slidably reciprocates within the casing 24 between an extended position, shown in FIG. 2A, and a retracted position, shown in FIG. 2B, and is biased towards the extended position by the control piston spring 34. Retraction of the control piston 32 is limited by the position of the end cap 62 relative to the casing 24, while extension of the control piston 32 is limited by the position of a control piston seat $\mathbf{24}_2$ within the casing 24. The actuation piston 26 is in the retracted position when the inner end face 27*i* of the actuation piston 26 engages a bottom face 60 of the cylindrical inner portion 58 of the hollow casing 24, as shown in FIG. 2A.

The casing 24 and the control piston 32 define a variable volume actuator chamber 64 within an innermost portion of the cylindrical actuator cavity 23 between an inner end (or bottom) face $\mathbf{66}_B$ of the control piston 32 and the control piston seat $\mathbf{24}_2$ within the casing 24. The bottom face $\mathbf{66}_B$ of the control piston 32 is engageable with the control piston seat $\mathbf{24}_2$ of the control piston 32 when the control piston 32 is in the extended position, as shown in FIG. 2A. An outer end (or top) face $\mathbf{66}_T$ of the control piston 32 is engageable with the end cap 62 of the casing 24 when in the retracted position of the control piston 32, as shown in FIG. 2B. The control piston spring 34 extends between the control piston 32 and the end cap 62 to bias the control piston 32 downwardly toward the retracted position. The control piston 32 is bored in order to form a vent chamber 68 between the control piston 32 and the end cap 62 to receive the control piston spring 34. The vent chamber 68 is subject to atmospheric pressure through at least one vent port 70 provided in the end cap 62 which exposes the outer end (or top) face $\mathbf{66}_T$ of the control piston 32 to atmospheric pressure. The control piston 32 is adapted to reciprocate between the control piston seat $\mathbf{24}_2$ of the casing 24 and the end cap 62.

The CBCM 22 also comprises a reset check (i.e., one-way) valve 35, including a valve member 36, preferably in the form of a spherical ball member, and a biasing valve spring 38. The valve member 36 is biased towards valve seat $\mathbf{24}_3$ in the casing 24 by the biasing valve spring 38. The CBCM 22 further comprises a supply (or inlet) port 44 formed within the casing 24. The supply port 44 is fluidly connected to the brake fluid passageway 20 in the engine brake rocker arm 14, as shown in FIG. 1, to provide pressurized hydraulic fluid from a source of the pressurized hydraulic fluid to the actuation piston cavity 42 through control piston channels 46. Thus, pressurized hydraulic fluid may flow into the inlet port 44 in the casing 24, and through the control piston channels 46 into the internal actuator cavity 23 and the actuation piston cavity 42, in order to cause extension of the actuation piston 26 from the casing 24.

The control piston 32 of the compression brake actuator 30 selectively engages the valve member 36 of the reset check valve 35 when the CBCM 22 is deactivated so as to unlock the actuation piston cavity 42 (as shown in FIG. 2A) and fluidly connect the actuation piston cavity 42 to the supply port 44 of the pressurized hydraulic fluid. When activated, the control piston 32 disengages the valve member 36 so as to lock the actuation piston cavity 42 and fluidly disconnect the actuation piston cavity 42 from the supply port 44 of the pressurized hydraulic fluid, as best shown in FIG. 2B.

According to the exemplary embodiment of the present invention, the CBCM 22 further comprises a hydraulic seal (or sealing device) 40 to limit hydraulic leakage and minimize hydraulic compliance during engine braking. As best shown in FIGS. 2A and 2B, the hydraulic seal 40 is mounted to a smooth outer peripheral surface 290 of the actuation piston 26. The hydraulic seal 40 is disposed between the actuation piston 26 and the cylindrical control bore 21 of the exhaust rocker arm 14 to eliminate piston-to-bore leakage of the pressurized hydraulic fluid. The seal 40 is eliminates oil leakage from the cylindrical control bore 21 of the exhaust rocker arm 14 and holds the actuation piston 26 in the retracted position without an additional return spring. As shown in FIG. 1, the CBCM 22 is threadedly engaged into the driving end $\mathbf{15}_1$ of the engine brake rocker arm 14. As best shown in FIG. 2B, a variable volume actuation piston cavity 42 is defined between the engine brake rocker arm 14, the casing 24 and the actuation piston 26.

The actuation piston cavity 42 in the actuation piston 26 and the internal actuator cavity 23 in the hollow casing 24 are in fluid communication with each other through a connecting passage 59 in the hollow cylindrical inner portion 58 of the hollow casing 24. As illustrated in FIGS. 2A-2B, the control piston pin 33 of the control piston 32 extends into the connecting passage 59 in the hollow cylindrical inner portion 58 of the hollow casing 24 towards the valve member 36 of the reset check valve 35.

In the deactivated state (i.e., depressurized condition) of the CBCM 22, the ball valve member 36 is prevented from interfacing with the valve seat $\mathbf{24}_3$ in the casing 24 by the control piston pin 33. The control piston pin 33 extends into the cylindrical inner portion 58 of the hollow casing 24 toward the valve member 36 of the reset check valve 35.

Depending on the presence of the hydraulic seal 40, the actuation piston 26 is also capable of extending due to the force of the biasing valve spring 38 or due to road vibrations. If the fluid pressure in the supply port 44 is insufficient to lift the control piston 32 into the retracted positon, then the actuation piston 26 will not be capable of supporting a force greater than the force created to extend it. As a consequence, any significant force applied to the outer end face 27*o* of the actuation piston 26 causes the activation piston 32 to retract.

In the deactivated state of the CBCM 22, friction from the hydraulic seal 40 is the sole retention force acting on the actuation piston 26 of FIGS. 2A and 2B. The actuation piston 26 of the CBCM 22 moveably mounted to the oscillating rocker arm 14, according to the present invention, an additional retention force is provided to avoid 'clatter' with the valve bridge 4.

The CBCM 22 is activated by raising the hydraulic pressure in the supply port 44 to a level which causes the control piston 32 to reach its retracted position, as shown FIG. 2B. This in turn allows the valve member 36 to contact the valve seat $\mathbf{24}_3$, forming the one-way (check) valve 35 in the actuation piston cavity 42. Any force applied to the contact face 27*o* of the actuation piston 26 is supported by a further raising of the hydraulic pressure within the actuation piston cavity 42.

The CBCM 22 is de-activated by lowering the hydraulic pressure in the supply port 44 to a level which allows the control piston 32 to move towards the extended position, shown in FIG. 2A. The force must be removed from the contact face 27*o* of the actuation piston 26 before the valve member 36 can be lifted away from the valve seat $\mathbf{24}_3$. Once the valve member 36 is lifted and the control piston 32 fully extended, then the actuation piston 26 can no longer support a significant force. Activation and deactivation of the control module 22 typically is through a switch in the operator's cab, which also causes fuel to be turned off to the engine.

A method of operating an exhaust rocker assembly 12 for operating at least one exhaust valve $\mathbf{2}_1$ of an internal combustion engine during a compression-release engine braking operation is as follows. First, the reset check valve 35 is biased closed when the pressurized hydraulic fluid is supplied from the compression brake fluid passageway 20 to the CBCM 22 to extent the hollow activation piston 26 and hydraulically activate the compression brake actuator 30 during a braking operation mode of the internal combustion engine. Next, the reset check valve 35 is hydraulically biasing closed during a valve brake lift of the at least one exhaust valve $\mathbf{2}_1$. Then, the pressurized hydraulic fluid is stopped to be supplied from the source 80 to the CBCM 22. As a result, the reset check valve 35 is biased open and allows retraction of the hollow activation piston 26 during a positive power operation mode of the engine. Consequently, the at least one exhaust valve $\mathbf{2}_1$ is reset by opening the reset check valve 35 and releasing hydraulic fluid from the actuation piston cavity 42 to close the at least one exhaust valve 21.

Figure 3:
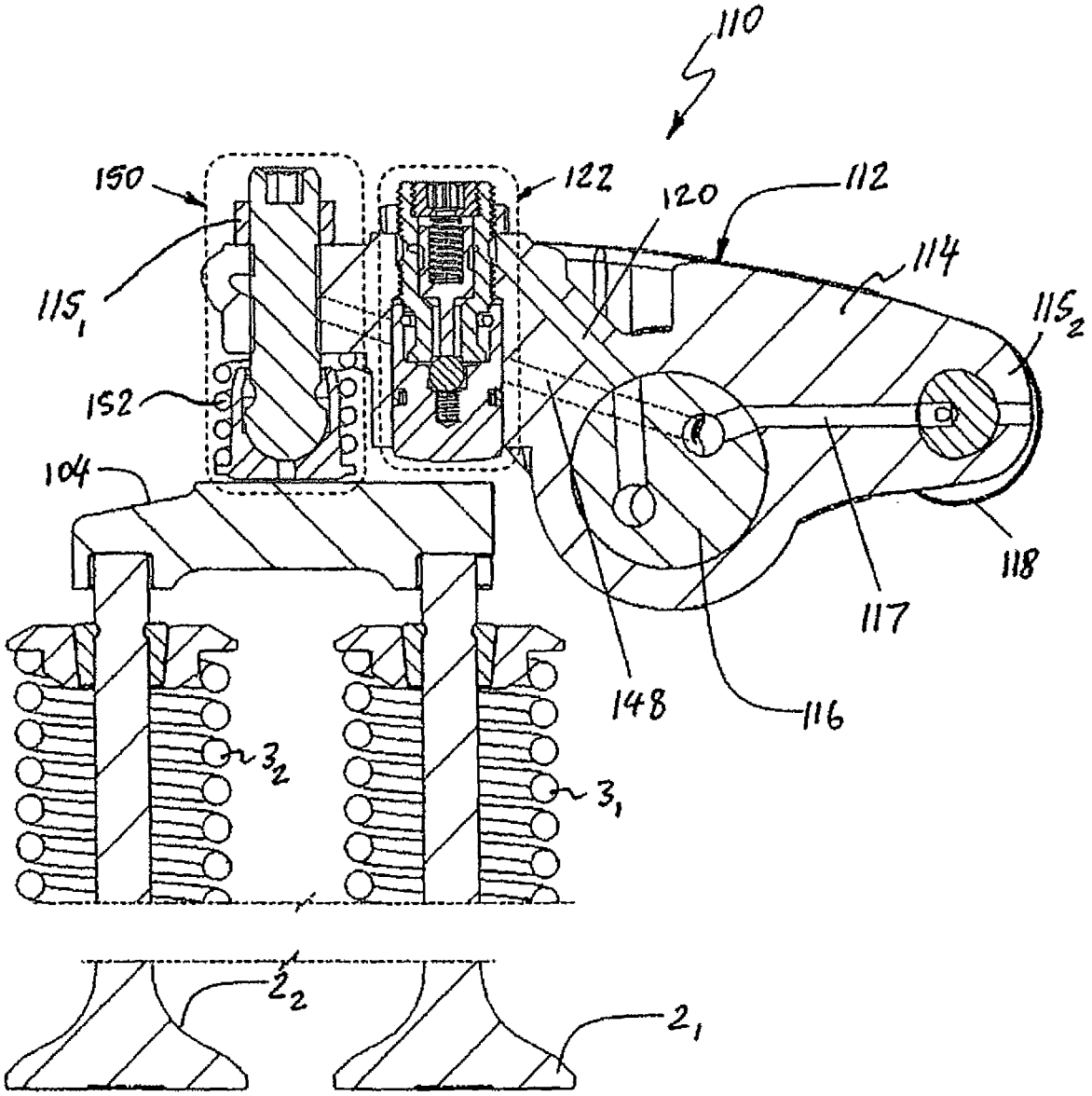
FIG. 3 is a sectional view of a lost motion compression-release engine brake rocker assembly according to a second exemplary embodiment of the present invention.

FIG. 3 depicts a compression-release brake 110 according to a second exemplary embodiment of the present invention, provided for an internal combustion (IC) engine, such as a diesel engine. Components, which are unchanged from the first exemplary embodiment, are labeled with the same reference characters. Components, which function in the same way as in the first exemplary embodiment depicted in FIGS. 1-2B are designated by the same reference numerals to some of which 100 has been added, sometimes without being described in detail since similarities between the corresponding parts in the two embodiments will be readily perceived by the reader.

The compression-release brake 110 is a lost motion compression-release engine brake system (or lost motion exhaust rocker arm engine brake system) with automatic hydraulic adjusting and resetting functions. The term "lost motion" identifies a type of rocker arm brake that adds an additional small lift profile to the exhaust cam lobe that opens the exhaust valve(s) near TDC of the compression stroke when excess exhaust valve lash is removed from the valve train. Preferably, the IC engine is a four-stroke diesel engine, conventionally comprising a cylinder block including one or more cylinders (not shown). Each cylinder is provided with two intake valves (not shown), and first (or braking) and second exhaust valves $\mathbf{2}_1$ and $\mathbf{2}_2$, and a valve train for lifting (opening) and closing of the exhaust valves $\mathbf{2}_1$ and $\mathbf{2}_2$. Each of the exhaust valves $\mathbf{2}_1$ and $\mathbf{2}_2$ is provided with a return spring exerting a closing force on the exhaust valves to urge the exhaust valves $\mathbf{2}_1$ and $\mathbf{2}_2$ into the closed position. The return springs of the first and second exhaust valves $\mathbf{2}_1$ and $\mathbf{2}_2$ (also known as exhaust valve springs) are designated by reference numerals $\mathbf{3}_1$ and $\mathbf{3}_2$, respectively.

The exhaust valves $\mathbf{2}_1$ and $\mathbf{2}_2$ are substantially structurally identical in this embodiment. In view of these similarities, and in the interest of simplicity, the following discussion will sometimes use a reference numeral without a letter to designate both substantially identical valves. For example, the reference numeral 2 will be sometimes used when generically referring to each of the exhaust valves $\mathbf{2}_1$ and $\mathbf{2}_2$ rather than reciting all two reference numerals. It will be appreciated that each engine cylinder may be provided with one or more intake valve(s) and/or exhaust valve(s), although two of each is shown in FIG. 3.

The IC engine is capable of performing a positive power operation (normal engine cycle) and an engine brake operation (engine brake cycle). The compression-release brake system 110 operates in a compression brake (or brake-on) mode during the engine brake operation and a compression brake deactivation (or brake-off) mode during the positive power operation.

The lost motion compression-release brake system 110 comprises a conventional intake rocker assembly (not shown) for operating intake valve(s), and a lost motion exhaust rocker assembly 112 for operating at least one of the first exhaust valve $\mathbf{2}_1$ and the second exhaust valve $\mathbf{2}_2$. Moreover, the exhaust rocker assembly 112 is provided with automatic hydraulic adjusting and resetting functions, as herein explained. The lost motion exhaust rocker assembly 112 includes a lost motion exhaust rocker arm 114 pivotally mounted for movement about an engine rocker shaft 116 to open the first and second exhaust valves $\mathbf{2}_1$ and $\mathbf{2}_2$ through an exhaust valve bridge 104. The rocker shaft 116 allows the exhaust rocker arm 114 to transfer camshaft motion to the exhaust valves $\mathbf{2}_1$ and $\mathbf{2}_2$ through the exhaust valve bridge 104, i.e., moving one or both of the exhaust valves $\mathbf{2}_1$ and $\mathbf{2}_2$ into an open position, which are returned to the closed position by the exhaust valve springs $\mathbf{3}_1$ and $\mathbf{3}_2$. The lost motion exhaust rocker arm 114, as best shown in FIG. 3, has two ends: a driving (first distal) end $\mathbf{115}_1$ controlling the exhaust valves $\mathbf{2}_1$ and $\mathbf{2}_2$, and a driven (second distal) end $\mathbf{115}_2$ adapted to contact a dedicated engine brake cam (not shown). The lost motion exhaust rocker arm 114 includes an exhaust cam follower 118 mounted to the driven end $\mathbf{115}_2$ of the lost motion exhaust rocker arm 114, as best shown in FIG. 3. The exhaust cam follower 118 is, for example, a cylindrical roller rotatably mounted to the driven end $\mathbf{115}_2$ of the exhaust rocker arm 114. The exhaust cam follower 118 contacts an exhaust cam (not shown). The exhaust cam follower 118 receives input motion from the exhaust cam. Thus, the exhaust cam follower 118 defines a camshaft interface. The rocker shaft 116 delivers continuous lubrication to the exhaust cam follower 118 via a lubrication conduit 117 formed in the exhaust rocker arm 114. Alternatively, the camshaft interface can be adapted to suit engine requirements, for example with a ball or socket for a push-rod type interface.

As further illustrated in FIG. 3, the lost motion rocker assembly 112 comprises a self-contained compression brake control module (or CBCM) 122 for selectively controlling the lift and phase angle of one or both of the exhaust valves $\mathbf{2}_1$ and $\mathbf{2}_2$, and a slider screw assembly 150. As shown in FIG. 3, the CBCM 122 is placed above the exhaust valve bridge 104 and the braking exhaust valve $\mathbf{2}_1$, while the slider screw assembly 150 is centered above the valve bridge 104. The rocker shaft 116 selectively delivers pressurized hydraulic fluid to the CBCM 122 via a brake fluid passageway 120 formed in the exhaust rocker arm 114, and delivers continuous lubrication to the slider screw assembly 150 via a lubrication conduit 148 formed in the exhaust rocker arm 114.

The exhaust cam (not shown) pivots the exhaust rocker arm 114 towards the valve bridge 104 to open and close the exhaust valves $\mathbf{2}_1$ and $\mathbf{2}_2$ during a normal exhaust stroke. After the conclusion of normal exhaust motion, the exhaust cam profile moves away from the exhaust cam follower 118, allowing the exhaust cam follower 118 to move (rotate) away from the valve bridge 104. The slider screw assembly 150 lengthens under the force of slider spring 152 to pivot the exhaust rocker arm 114 towards the exhaust cam, maintaining the exhaust cam follower 118 in contact with the exhaust cam as it moves away.

The exhaust cam drives the exhaust rocker arm 114 towards the valve bridge 104 near TDC of the compression stroke. This oscillating motion of the exhaust rocker arm 114 is not transmitted to the exhaust valves $\mathbf{2}_1$ and $\mathbf{2}_2$ during the normal (or positive power) engine operation (or the brake-off mode of the lost motion compression-release engine brake system 110), i.e., it is "lost" to the valves.

The lost motion compression-release engine brake system 110 is energized by supplying pressurized hydraulic fluid to the brake fluid passageway 120 and the CBCM 122. The pressurized fluid causes the CBCM 122 to extend during the 'away' portion of the cycle, i.e., when the driving end $\mathbf{115}_1$ of the exhaust rocker arm 114 with the CBCM 122 pivots away from the exhaust valve bridge 104. The CBCM 122 maintains the extended position until the pressurized fluid is removed (as described in the U.S. Pat. No. 11,149,659). The CBCM 122 extends sufficiently far that the 'lost' motion is then 'found' by the braking exhaust valve 21, and the braking exhaust valve $\mathbf{2}_1$ is opened near TDC compression stroke.

Alternatively, the overhead exhaust cam follower 118 may be substituted with a cam-in-block push tube assembly, and the function of the lost motion compression-release engine brake system 110 as otherwise disclosed will be retained. It will also be evident that a valve bridge pin through the valve bridge 104, as shown in FIG. 3, may be implemented to control contact pressures at the interface between the braking exhaust valve $\mathbf{2}_1$, the valve bridge 104, and the CBCM 122 without compromise of function as disclosed.

FIGS. 4A and 4B are sectional views of the hydraulically actuated CBCM 122 of the second exemplary embodiment in the deactivated and activated state, respectively.

The CBCM 122 comprises a reset check (i.e., one-way) valve 135 including a valve member 136, preferably in the form of a spherical ball member, and a biasing valve spring 138. The CBCM 122 also comprises a hollow casing 124 in the form of a cylindrical single-piece hollow body, an actuation piston 126 slidingly mounted to the casing 124, and a retaining ring 128 mounted to the actuation piston 126.

FIGS. 4A and 4B show an actuation piston bias mechanism including an actuation piston bias spring 153 disposed in an actuation piston cavity 142, an actuation bias washer 154, and an actuation bias retaining ring 156. The cylindrical single-piece casing 124 receives the actuation bias washer 154 and the actuation bias retaining ring 156 such that the actuation piston bias spring 153 is disposed therebetween. The actuation piston 126 is biased towards the extended position by the actuation piston bias spring 153. An extension limit of the actuation piston 126 is defined by the position of retaining ring 128 mounted to the actuation piston 126, and the actuation bias washer 154 in the actuation piston 126, and a washer ring seat 155 in the casing 124. In the deactivated state, the biasing valve spring 138 creates a minimum force threshold which must be overcome to move the actuation piston 126 toward the retracted position (shown in FIG. 4A), resisting extension due to low hydraulic pressure of the hydraulic fluid in the brake fluid passageway 120, motion of the exhaust rocker arm 114, and external vibrations.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

We claim:

1. An exhaust rocker assembly for operating at least one exhaust valve of an internal combustion engine during a compression-release engine braking operation, the exhaust rocker assembly comprising:

an exhaust rocker arm; and a self-contained compression brake control module mounted to the exhaust rocker arm and operatively coupled to the at least one exhaust valve so as to control a lift and a phase angle of the at least one exhaust valve, the compression brake control module maintaining the at least one exhaust valve open during a compression stroke of the internal combustion engine when in the compression-release engine braking operation, the compression brake control module comprising:

a hollow casing including a single-piece body mounted in the exhaust rocker arm, the casing defining an internal actuator cavity, and a hollow inner portion extending away from the internal actuator cavity;

a hollow actuation piston disposed outside the casing and in the exhaust rocker arm so as to receive the inner portion, the actuation piston defining a variable volume hydraulic actuation piston cavity between the casing and the actuation piston, the actuation piston reciprocating relative to the inner portion between an extended position and a collapsed position, the actuation piston configured to engage the at least one exhaust valve when in the extended position;

a connecting passage arranged in the casing so as to fluidly connect the actuation piston cavity to the internal actuator cavity;

a reset check valve arranged between the connecting passage and the actuation piston cavity, the reset check valve configured to hydraulically lock the actuation piston cavity when a pressure of hydraulic fluid within the actuation piston cavity exceeds a pressure of hydraulic fluid in a supply port formed in the casing, the reset check valve biased closed via a biasing spring;

a compression brake actuator slidably arranged in the internal actuator cavity so as to control the reset check valve, the compression brake actuator including a control piston exposed to atmospheric pressure, the control piston configured to reciprocate between an extended position and a retracted position; and a control piston spring biasing the control piston toward the extended position in which the control piston engages and opens the reset check valve solely via a biasing force of the control piston spring so as to unlock the actuation piston cavity and fluidly connect the actuation piston cavity to the supply port;

wherein the actuation piston includes an inner peripheral surface defining a groove, and a retaining ring mounted to the groove, wherein the inner portion includes an outer peripheral surface defining an inner stopping surface, and wherein the retaining ring is configured to engage the inner stopping surface so as to stop movement of the actuation piston relative to the casing when the actuation piston reaches the extended position when the retaining ring engages the inner stopping surface.

2. The exhaust rocker assembly as defined in claim 1, wherein the supply port is fluidly connected to a compression brake fluid passageway formed in the exhaust rocker arm, and wherein the supply port is configured to provide pressurized hydraulic fluid to the actuation piston cavity via the connecting passage.

3. The exhaust rocker assembly as defined in claim 1, wherein the exhaust rocker arm includes a control bore configured to receive the actuation piston so as to define the actuation piston cavity, and wherein the actuation piston reciprocates in the control bore.

4. The exhaust rocker assembly as defined in claim 3, wherein the single-piece body includes a partially threaded outer cylindrical surface configured to engage the control bore.

5. The exhaust rocker assembly of claim 3, wherein the actuation piston further includes an outer seal and a smooth outer surface configured to engage, seal against, and reciprocate within the control bore.

6. The exhaust rocker assembly as defined in claim 1, wherein the inner portion separates the internal actuator cavity from the actuation piston cavity, and wherein the connecting passage is formed in the inner portion.

7. The exhaust rocker assembly as defined in claim 1, wherein the control piston includes a bottom face exposed to the hydraulic fluid, and a top face exposed to atmospheric pressure.

8. The exhaust rocker assembly as defined in claim 7, wherein the actuator cavity is closed with an end cap including a vent port.

9. The exhaust rocker assembly of claim 1, wherein the control piston includes:

a bottom face configured to engage a control piston seat when the control piston is in the extended position, and a top face configured to engage an end cap which closes the internal actuator cavity when the control piston is in the retracted position.

10. The exhaust rocker assembly of claim 1, wherein the control piston spring is disposed within the casing between the control piston and an end cap.

11. The exhaust rocker assembly of claim 1, wherein the exhaust rocker arm is a dedicated engine brake rocker arm pivotally mounted about an engine brake rocker shaft, the engine brake rocker arm configured to open the at least one exhaust valve via only a valve bridge pin extending through an exhaust valve bridge.

12. The exhaust rocker assembly of claim 1, wherein the exhaust rocker arm is a lost motion exhaust rocker arm pivotally mounted about an engine rocker shaft, the lost motion exhaust rocker arm configured to open the at least one exhaust valve through an exhaust valve bridge.

13. The exhaust rocker assembly of claim 1, wherein the actuation piston includes an inner end face, and an outer end face configured to engage the at least one exhaust valve when the actuation piston is in the extended position.

14. A lost motion exhaust rocker assembly for operating the at least one exhaust valve of an internal combustion engine during a compression-release engine braking operation, the lost motion exhaust rocker assembly comprising:

a lost motion exhaust rocker arm;

a slider screw assembly and a self-contained compression brake control module each mounted to the lost motion exhaust rocker arm and operatively coupled to the at least one exhaust valve via an exhaust valve bridge so as to control a lift and a phase angle of the at least one exhaust valve, the compression brake control module maintaining the at least one exhaust valve open during a compression stroke of the internal combustion engine when in the compression-release engine braking operation, the compression brake control module comprising:

a hollow casing including a single-piece body mounted in the lost motion exhaust rocker arm, the hollow casing defining an internal actuator cavity, a hollow inner portion extending away from the internal actuator cavity;

a hollow actuation piston disposed outside the casing and in the lost motion exhaust rocker arm defining a variable volume hydraulic actuation piston cavity between the casing and the actuation piston, the actuation piston reciprocating relative to the inner portion between an extended position and a collapsed position, the actuation piston configured to engage the at least one exhaust valve when in the extended position;

a connecting passage arranged in the casing so as to fluidly connect the actuation piston cavity to the internal actuator cavity;

an actuation piston bias spring disposed in the actuation piston cavity, the actuation piston bias spring configured to bias the actuation piston towards the extended position;

a reset check valve arranged between the connecting passage and the actuation piston cavity, the reset check valve configured to hydraulically lock the actuation piston cavity when a pressure of hydraulic fluid within the actuation piston cavity exceeds a pressure of hydraulic fluid in a supply port formed in the casing, the reset check valve biased closed via a biasing spring;

a compression brake actuator slidably arranged in the internal actuator cavity so as to control the reset check valve, the compression brake actuator including a control piston exposed to atmospheric pressure, the control piston configured to reciprocate between an extended position and a retracted position; and a control piston spring biasing the control piston toward the extended position in which the control piston engages and opens the reset check valve solely via a biasing force of the control piston spring so as to unlock the actuation piston cavity and fluidly connect the actuation piston cavity to the supply port, wherein the actuation piston includes an inner peripheral surface defining a groove, and a retaining ring mounted to the groove, wherein the inner portion includes an outer peripheral surface defining an inner stopping surface, and wherein the retaining ring is configured to engage the inner stopping surface so as to stop movement of the actuation piston relative to the casing when the actuation piston reaches the extended position.

15. The exhaust rocker assembly of claim 14, wherein the slider screw assembly is centered above the exhaust valve bridge.

16. The exhaust rocker assembly of claim 14, wherein the slider screw assembly and self-contained compression brake control module are mounted to a first distal end of the lost motion exhaust rocker arm.

17. A method of operating the exhaust rocker assembly of claim 3, the method comprising:

supplying a pressurized hydraulic fluid from a compression brake fluid passageway to the compression brake control module so as to extend the actuation piston and hydraulically close the reset check valve during a braking operation mode of the engine; and stopping the pressurized hydraulic fluid supplied to the compression brake control module so as to open the reset check valve thereby retracting the actuation piston during a positive power operation mode of the engine.

* * * * *